United States Patent [19]

Nishida

[11] Patent Number: 4,667,619

[45] Date of Patent: May 26, 1987

[54] BOTTOM PROTECTOR FOR A SMALL BOAT

[75] Inventor: Hiroshi Nishida, Miki, Japan

[73] Assignee: Kawasaki Jukogyo Kabushiki Kaisha, Kobe, Japan

[21] Appl. No.: 723,256

[22] Filed: Apr. 15, 1985

[30] Foreign Application Priority Data

Apr. 21, 1984 [JP] Japan ..... 59-59282

[51] Int. Cl.[4] ..... B63B 17/00

[52] U.S. Cl. ..... 114/361; 114/343; 114/270; 114/357

[58] Field of Search ..... 114/352, 353, 354, 357, 114/361, 219, 343, 67 R, 270, 271, 279, 284, 291, 56; 244/100 A, 101, 105, 106

[56] References Cited

U.S. PATENT DOCUMENTS 3,190,587 6/1965 Fries ..... 244/106

3,270,701 9/1966 Kubas ..... 114/219 X 3,680,516 8/1972 Loverdos-Stelakatos ..... 114/67 R

FOREIGN PATENT DOCUMENTS 0076383 5/1983 Japan ..... 114/56

*Primary Examiner*—Joseph F. Peters, Jr.

*Assistant Examiner*—Paul E. Salmon

*Attorney, Agent, or Firm*—Marshall, O'Toole, Gerstein, Murray and Bicknell

[57] ABSTRACT

This disclosure relates to a flexible bottom protector for a small boat including a bottom wall. The bottom wall has at least two laterally spaced grooves extending substantially longitudinally of the boat, and the protector comprises a portion which extends across the bottom wall and between the grooves. Side ridges are formed on the portion of the protector for engagement with the grooves, and the protector further has bow and stern ends secured to the boat.

5 Claims, 3 Drawing Figures

BOTTOM PROTECTOR FOR A SMALL BOAT

FIELD AND BACKGROUND OF THE INVENTION

This invention relates to the construction of a boat or watercraft, and more particularly to a protective cover for the underside of the hull of such a craft In the example of the invention described and illustrated herein, the boat is a relatively small type, primarily for recreational use by a single person. Such a boat includes a hull and deck which are secured together and enclose an engine. The hull of such a boat has a duct formed therein which extends along the bottom of the boat to the stern, and the duct houses a water jet propulsion arrangement. The boat may often be used in shallow water or driven ashore, and consequently its bottom may wear away or be otherwise damaged.

BRIEF SUMMARY OF THE INVENTION

Apparatus according to the invention comprises a replaceable protector for the bottom side of a boat. The bottom side has at least two spaced, longitudinally extending grooves in it, and the protector includes a portion extending between the grooves and ridges extending into the grooves.

BRIEF DESCRIPTION OF THE DRAWINGS

A preferred embodiment of the invention is shown in the accompanying figures of the drawings, wherein.

DETAILED DESCRIPTION OF THE DRAWINGS

Figure 1:
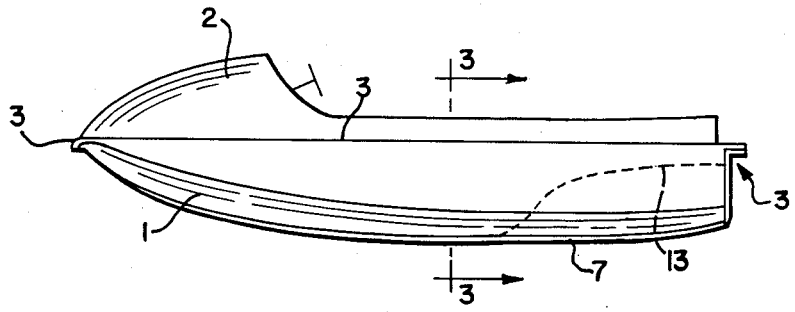
FIG. 1 is a side view of a small boat including a protector embodying the invention.

In the drawings, the body of the boat includes a lower hull part 1 and an upper deck part 2, each having a circumferential flange 3. The flanges are interconnected in a suitable manner such as by bolts 6 (FIG. 2) at the bow and the stern of the boat.

Figure 3:
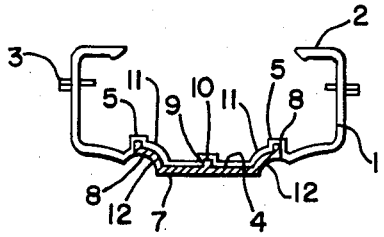
FIG. 3 is a fragmentary sectional view taken along the line 3—3 in FIG. 1.

As shown in FIG. 3, the lower hull part 1 has a relatively flat, longitudinal bottom surface 4, which extends from the bow to the stern and is located at the lowest level in the boat. In this example, the surface 4 forms approximately the center one-third of the total bottom. The lower hull part 1 further has longitudinal grooves formed therein, one center groove 9 on the keel line and two longitudinal outer grooves 5 on the sides of the surface 4.

A flexible cover or protector 7 extends across the bottom surface 4 and adjacent surfaces of the lower hull part 1. The protector 7 has longitudinal center ridge 10 in the groove 9 and two side ridges 8 for engagement in the grooves 5. The protector 7 may be formed of a plastic such as synthetic resin, for example a polymer polyethylene or other abrasion-proof material having a relatively low rigidity.

Figure 2:
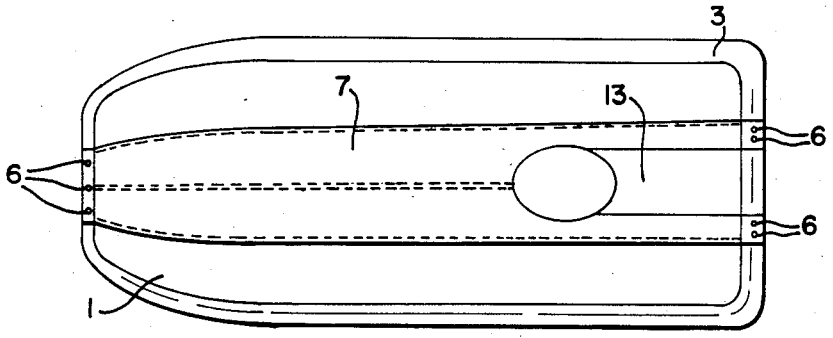
FIG. 2 is a view of the bottom of the boat.

As shown in FIGS. 1 and 2, the protector extends from the flange 3 at the bow, curves downwardly and along the bottom surface 4, and bends upwardly to the flange 3 at the stern. The protector 7 may be secured on the lower hull part 1 by fixing the stern, for example, end of the protector 7 to the lower flange 3 by the bolts 6, then engaging the ridges 8 and 10 in the grooves 5 and 9, and finally fixing the bow end of the protector 7 to the lower flange 3 by the bolts 6. It will be understood that the protector 7 can be removed simply 7 in reverse order.

With reference to FIG. 3, at each edge of the flat bottom surface 4 is an upwardly arcuate portion 11 of hull, and the protector 7 includes arcuate portions 12 of the conform with the portions 11. The ridges 8 and the grooves 5 are formed within the arcuate portions and are displaced upwardly from the lowermost flat bottom surface 4. Consequently the ridges 8 and the grooves 5 are at relatively protected locations in the arcuate portions. Further, the arcuate portions provide added flexibility to the bottom of the boat and the protector.

A conventional engine and propulsion system are provided in the hull of the boat. A cavity 13 (FIGS. 1 and 2) is formed in the bottom of the hull, which extends to the stern of the boat, and the propulsion system forms a jet through the cavity 13. The arcuate portions 11 of the hull extend longitudinally along the edges of the cavity 13 as shown in FIG. 2. The rearward part of the cover 7 is bifurcated and the arcuate portions 12 of the cover and the immediately adjacent portions of the flat bottom 7 also extend longitudinally along the edges of the cavity 13, and two spaced flat portions of the protector extend upwardly at the stern.

What is claimed is:

1. A flexible bottom protector for use with a boat including a relatively rigid bottom wall, the bottom wall having a longitudinal center line and at least two laterally spaced grooves extending substantially longitudinally of said boat, said protector comprising a portion adapted to extend across and conform closely with said bottom wall between said grooves during operation of said boat, said protector extending across the center line and both sides of said bottom wall, and side ridges on said portion for engagement with said grooves, said protector further having bow and stern ends adapted to be secured to said boat, said bottom wall further having a substantially longitudinal center groove therein between said laterally spaced grooves, and said protector further comprising a center ridge between said side ridges for connection with said center groove.

2. A flexible bottom protector for use with a boat including a relatively rigid bottom wall, the bottom wall having a longitudinal center line and at least two laterally spaced grooves extending substantially longitudinally of said boat, said protector comprising a portion adapted to extend across and conform closely with said bottom wall between said grooves during operation of said boat, said protector extending across the center line and both sides of said bottom wall, and side ridges on said portion for engagement with said grooves, said protector further having bow and stern ends adapted to be secured to said boat, said bottom wall further having arcuate portions adjacent said side grooves and said side grooves being formed within said arcuate portions, said arcuate portions curving upwardly and away from said center line of the boat, said protector further comprising arcuate portions adapted to extend into and conform with said arcuate portions of the bottom wall, and said side ridges being formed on said arcuate portions of said protector.

3. A boat comprising a bottom wall, said bottom wall having a longitudinal center line and at least two laterally spaced grooves extending substantially longitudinally of said boat, and a protector comprising a portion extending across and conforming closely with said bottom wall between said grooves during operation of said boat, said protector extending across the center line and both sides of said bottom wall, and side ridges on said portion in engagement with said grooves, said protector further having bow and stern ends secured to ends of said boat, said bottom wall further having arcuate portions which are displaced upwardly and away from said center line, said grooves being formed in said arcuate portions, and said side ridges extending into said arcuate portions.

4. A boat comprising a bottom wall, said bottom wall having a longitudinal center line and at least two laterally spaced grooves extending substantially longitudinally of said boat, and a protector comprising a portion extending across and conforming closely with said bottom wall between said grooves during operation of said boat, said protector extending across the center line and both sides of said bottom wall, and side ridges on said portion in engagement with said grooves, said protector further having bow and stern ends secured to end of said boat, said bottom wall further comprising a substantially longitudinal center groove therein between said laterally spaced grooves, and said protector further comprising a center ridge between said side ridges for connection with said center groove.

5. A fexible bottom protector for use with a boat including a relatively rigid bottom wall, the bottom wall having a longitudinal center line and at least two laterally spaced grooves extending substantially longitudinally of said boat, said protector comprising a portion adapted to extend across and conform closely with said bottom wall between said grooves during operation of said boat, said protector extending across the center line and both sides of said bottom wall, and side ridges on said portion for engagement with said grooves, said protector further having bow and stern ends adapted to be secured to said boat, said bottom wall further comprising arcuate portions adjacent said side grooves, said side grooves being formed within said arcuate portions, said arcuate portions curving upwardly and away from said center line of the boat, said protector further comprising arcuate portions extending into and conforming with said arcuate portions of the bottom wall, and said side ridges being formed on said arcuate portions of said protector.

* * * * *